US005709428A

United States Patent [19]

Hugghins

[11] Patent Number: 5,709,428

[45] Date of Patent: Jan. 20, 1998

[54] COLLAPSIBLE FOLDING FURNITURE

[75] Inventor: Joel F. Hugghins, McGregor, Tex.

[73] Assignee: Massachusetts Institute of Technology, Cambridge, Mass.

[21] Appl. No.: 650,511

[22] Filed: May 20, 1996

[51] Int. Cl.[6] ..... A47C 4/30; A47D 1/02

[52] U.S. Cl. ..... 297/16.2; 297/45; 135/127

[58] Field of Search ..... 297/16.2, 17, 42, 297/44, 45; 312/265.1, 265.2; 135/127

[56] References Cited

U.S. PATENT DOCUMENTS

| | | | |
|---|---|---|---|
| 3,223,098 | 12/1965 | Dole, Jr. | 135/127 X |
| 4,091,584 | 5/1978 | Brown | 135/127 |
| 4,547,015 | 10/1985 | Wakimot | 297/45 X |
| 4,605,261 | 8/1986 | Lee | 297/16.2 |
| 4,810,029 | 3/1989 | Kaladis | 297/16.2 |
| 4,869,280 | 9/1989 | Ewing | 135/69 |
| 4,877,044 | 10/1989 | Cantwell et al. | 135/127 |
| 5,054,849 | 10/1991 | Hoff | 297/45 |
| 5,362,130 | 11/1994 | Hoffman | 297/440.11 |
| 5,429,413 | 7/1995 | Levy et al. | 297/16.2 X |
| 5,507,548 | 4/1996 | Marhefka | 297/45 |

FOREIGN PATENT DOCUMENTS

| | | | |
|---|---|---|---|
| 63123 | 8/1955 | France | 297/45 |
| 1142576 | 9/1957 | France | 297/45 |
| 2254449 | 5/1974 | Germany | 297/45 |
| 2226831 | 7/1990 | United Kingdom | 135/127 |

*Primary Examiner*—Peter M. Cuomo
*Assistant Examiner*—Rodney B. White
*Attorney, Agent, or Firm*—Theresa A. Lober

[57] ABSTRACT

The present invention provides collapsible folding furniture that overcomes the limitations of past furniture configurations to achieve strong and lightweight furniture structures that have full size features and comfort but that are extremely compact, easy to set up, and that have no loose parts. A collapsible furniture support structure has a support surface extending between at least two side braces, and at least two leg supports for maintaining the support surface in a substantially horizontal position. A separate socket joint is provided that corresponds to each leg support. Each socket joint is slidingly engaged with an upper end of a corresponding leg support and engaged with an end of a side brace. A separate elastic cord is provided for each leg support, with each elastic cord connected between a corresponding leg support and socket joint. Each cord has a length selected to be in a state of tension when the corresponding leg support is engaged with the corresponding socket joint, as well as to enable the corresponding leg support to be disengaged from the corresponding socket joint and pivoted about the socket joint to the support surface while the cord remains connected. This support structure configuration enables the folding and collapsing of the components into a compact bundle having no loose parts, for easy transport and storage. The tension in the elastic cords also results in easy set-up of the structure without requiring assembly of separate components. The support surface is provided as a flexible material sized to support a seated person or alternative, to provide, e.g., a table, cot, or foot rest.

26 Claims, 5 Drawing Sheets

COLLAPSIBLE FOLDING FURNITURE

FIELD OF THE INVENTION

This invention relates to collapsible furniture configurations, and more particularly relates to furniture configurations that enable compact folding of furniture for storage and transportation.

BACKGROUND OF THE INVENTION

Portable compact furniture is becoming increasingly popular as the pace of lifestyles generally quickens. Portable furniture configurations enable the transporting of furniture between, e.g., home and the office, a recreational site, a sporting activity, or spectator function, and typically provide compact collapsible configurations for ease of storage and transport. Portable furniture is especially well-suited for recreational activities like camping and hiking in which equipment is often transported on foot.

Various portable furniture configurations, and portable chair configurations in particular, have been proposed to meet the challenges presented by recreational and other activities for ease of use and portability. Examples include ground-level or near ground-level seating platforms and support structures; while these configurations are typically small and easy to transport, they tend to be rather uncomfortable and awkward in use, however. On the other hand, full-size, above-ground portable chairs and other such structures generally are more comfortable in use but are not as compact and often are much heavier than the ground-level configurations. No matter the size or collapsing configuration though, portable chairs and portable furniture in general often includes many separate and complex parts that can be misplaced during transport or storage and that are difficult to assemble. Thus, configurations aimed at providing portable and compact furniture have been found to be generally lacking in one or more considerations for assembly or usage, and thus not fully meeting the needs of the quick-pace activities for which they were designed.

SUMMARY OF THE INVENTION

The present invention provides collapsible folding furniture that overcomes the limitations of past furniture configurations to achieve strong and lightweight furniture structures that have full size features and comfort but that are extremely compact, easy to transport, and easy to set up.

Accordingly, the invention provides a collapsible support structure having a support surface extending between at least two side braces, and at least two leg supports for maintaining the support surface in a substantially horizontal position. A separate socket joint is provided for each leg support. Each socket joint is slidingly engaged with an upper end of a corresponding leg support and engaged with an end of a side brace. A separate elastic cord is provided for each leg support, with each elastic cord connected between a corresponding leg support and socket joint. Each cord has a length selected to be in a state of tension when the corresponding leg support is engaged with the corresponding socket joint, as well as to enable the corresponding leg support to be disengaged from the corresponding socket joint and pivoted about the socket joint to the support surface while the cord remains connected.

This support structure configuration enables the folding and collapsing of the components into a compact bundle having no loose parts, for easy transport and storage. The tension in the elastic cords also results in easy set-up of the structure without requiring assembly of separate components. Preferably, a strap is connected on an underside of the support surface; the strap can provide a fastening mechanism for securing the strap around a bundle consisting of the leg supports pivoted to the support surface and wrapped in the support surface. In one embodiment, the support surface is provided as a flexible material sized to support a seated person. In other embodiments, the support surface comprises a table, cot, or foot rest.

In one configuration, the leg supports each are support tubes, and a separate support tube end cap is engaged at a lower end of each support tube. Here each elastic cord is threaded through a corresponding leg support tube and connected to an eyelet in the corresponding end cap. In alternative embodiments, each cord is connected to a corresponding support tube by a cotter pin in the support tube. Preferably, a support disk is engaged in the lower end of each support tube for distributing weight around the tube when the tube is supporting weight.

In yet other embodiments, the leg supports each are solid shafts, and each elastic cord is connected to a corresponding solid shaft by an eyelet in a cavity provided in the shaft. Each elastic cord is connected, in other embodiments, to a corresponding socket joint by an eyelet in the socket joint. Preferably, the socket joint is a socket elbow joint.

In one configuration provided by the invention, the leg supports form two X-shaped scissor leg structures each of two leg supports. Each X-shaped scissor leg structure includes two leg supports each having an upper support and a lower support. Each socket joint is slidingly engaged with an upper end of a corresponding upper support, and each elastic cord is connected between a corresponding socket joint and an upper support. Each X-shaped scissor leg structure has two pivotal joints, with each pivotal joint engaged with a lower end of a corresponding upper support and slidingly engaged with an upper end of a corresponding lower support. A separate lower elastic cord is connected between each lower support and a corresponding pivotal joint. The lower elastic cord has a length selected to be in a state of tension when the corresponding lower support is engaged with the corresponding pivotal joint, as well as to enable a corresponding lower support to be disengaged from a corresponding pivotal joint and pivoted about the pivotal joint to a corresponding upper support while the lower cord remains connected.

Preferably, each upper support is an upper support tube and each lower support is a lower support tube. Here a separate support tube end cap is engaged at a lower end of each lower support tube. Each lower elastic cord is threaded through a corresponding lower support tube and connected to an eyelet in a corresponding support tube end cap.

In another configuration provided by the invention, the support structure has three leg supports. Preferably, each leg support includes an upper support and a lower support. Each socket joint is slidingly engaged with an upper end of a corresponding upper support, and each elastic cord is connected between a corresponding socket joint and an upper support. A six-socketed joint is engaged with a lower end of each upper support and slidingly engaged with an upper end of each lower support. A separate lower elastic cord is connected between a corresponding lower support and the six-socketed joint and has a length selected to be in a state of tension when the corresponding lower support is engaged with the six-socketed joint, as well as to enable the corresponding lower support to be disengaged from the six-socketed joint and pivoted about the six-socketed joint while the lower cord remains connected.

The invention provides a collapsible folding chair having a rectangular seat extending between two side braces and a rectangular back extending between two back braces. Two back leg supports and two front leg supports are provided with the chair. A triple-socketed joint is provided for each back leg support, each triple-socketed joint being slidingly engaged with an upper end of a corresponding back leg support, slidingly engaged with a lower end of a back brace, and engaged with a back end of a side brace. An elastic cord is connected between each triple-socketed joint and the corresponding back leg support, and has a length selected to be in a state of tension when the corresponding back leg support is engaged with the corresponding triple-socketed joint, as well as to enable the corresponding back leg support to be disengaged from the corresponding triple-socketed joint and pivoted about the triple-socketed joint to an underside of the chair seat while the cord remains connected. An elastic cord is also connected between each triple-socketed joint and the corresponding back brace, and has a length selected to be in a state of tension when the corresponding back brace is engaged with the corresponding triple-socketed joint, as well as to enable the corresponding back brace to be disengaged from the corresponding triple-socketed joint and pivoted about the triple-socketed joint to an upper side of the chair seat while the cord remains connected.

A double-socketed joint is provided for each front leg support, each double-socketed joint being slidingly engaged with an upper end of a corresponding front leg support and engaged with a from end of a side brace. An elastic cord is connected between each double-socketed joint and the corresponding front leg support, and has a length selected to be in a state of tension when the corresponding from leg support is engaged with the corresponding double-socketed joint, as well as to enable the corresponding front leg support to be disengaged from the corresponding double-socketed joint and pivoted about the double-socketed joint to an underside of the chair seat while the cord remains engaged.

In preferred embodiments, the seat of the collapsible folding chair is at least about one foot off the ground. The chair seat and chair back are a single piece of flexible material, preferably. In embodiments provided by the invention, the leg supports include upper and lower leg support tubes of carbon fiber. The triple-socketed joints, in one configuration, are cast spherical joints, and in another configuration, both the triple-socketed joints and the double-socketed joints are injection molded plastic joints.

Preferably, the chair back makes an angle of greater than about ninety degrees with the chair seat, and the two back leg supports each preferably make an angle of greater than about ninety degrees with the chair seat.

Other features and advantages of the invention will apparent from the claims, and from the following description and accompanying drawings.

DETAILED DESCRIPTION

Figure 1A:
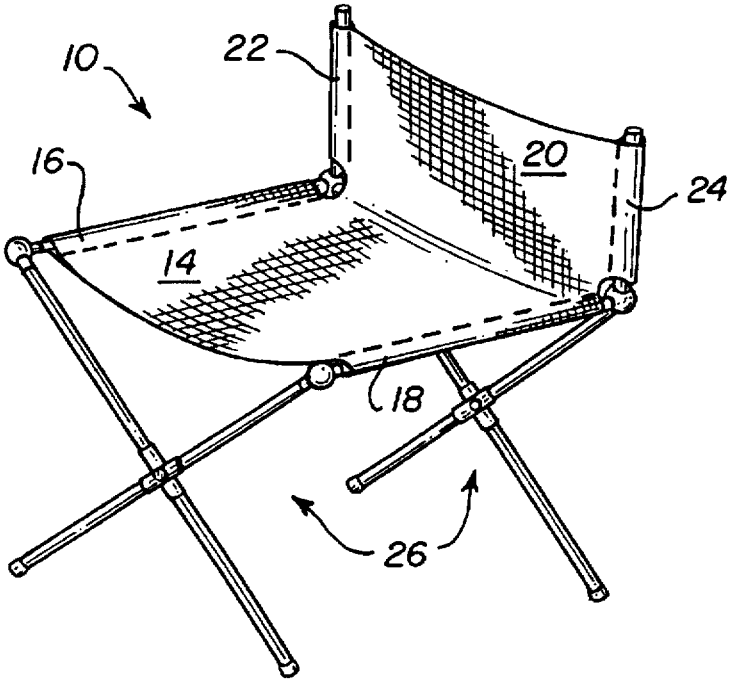
FIG. 1A is a perspective view of a chair configuration in accordance with the invention.
Figure 1B:
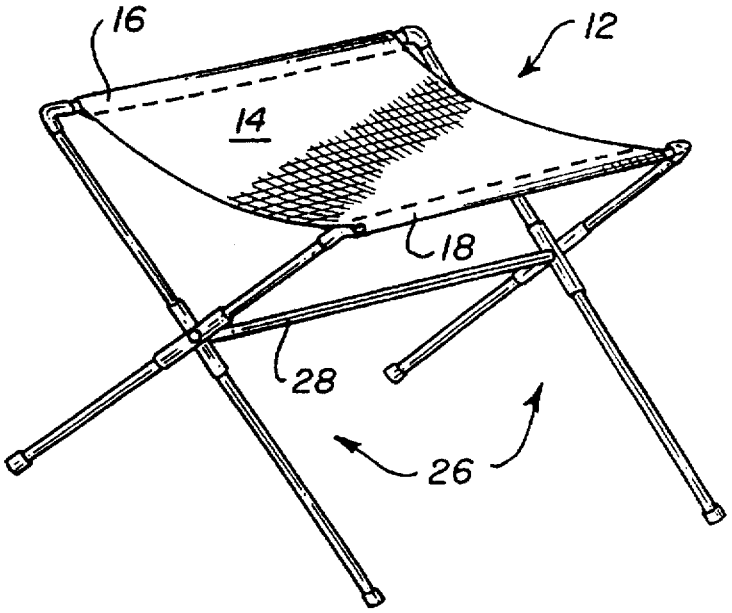
FIG. 1B is a perspective view of a stool configuration in accordance with the invention.

FIG. 1A shows a collapsible folding chair 10 and FIG. 1B shows a collapsible folding stool 12, these being first and second examples of collapsible folding furniture provided by the invention. The chair 10 includes a chair seat portion 14 supported between horizontal seat side braces 16, 18; likewise, the stool 12 includes a seat portion 14 supported between seat side braces 16, 18. The chair additionally includes a seat back portion 20 supported between vertical back side braces 22, 24. Leg supports configured as, e.g., X-shaped scissor legs 26 are provided by the chair and stool for ground support. Additional leg support structures, such as a cross-leg brace 28, as shown in FIG. 1B, can also be included.

Figure 2:
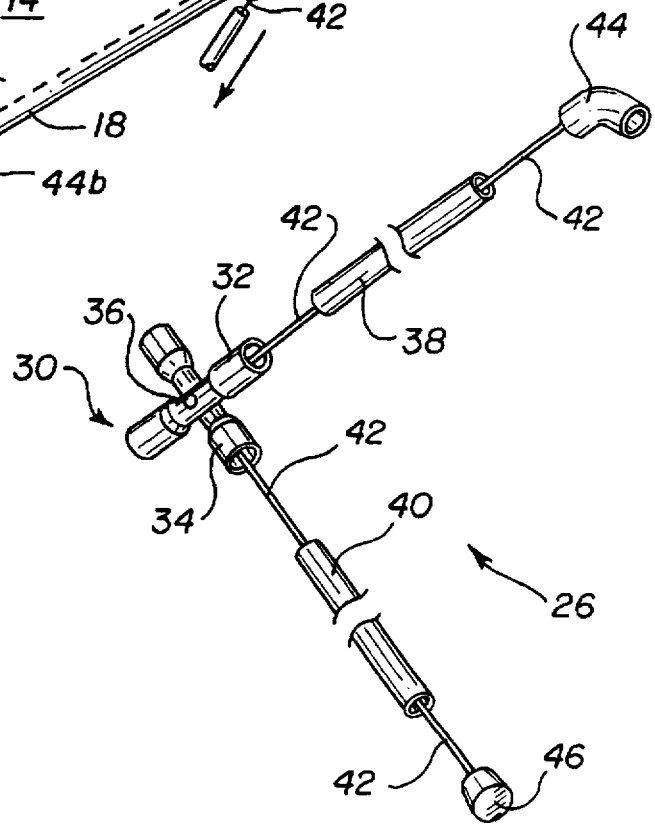
FIG. 2 is a schematic view of details of a scissor leg configuration shown in FIG. 1A having stretchable cord connectivity in accordance with the invention.

The folding mechanism provided by the invention for collapsing furniture such as the chair and stool of FIG. 1 into compact, portable configurations can be understood with reference to FIG. 2. FIG. 2 shows one X-shaped scissor leg support 26 for the chair or stool of FIG. 1. The leg support 26 includes pivotal joints 32, 34 connected about a pivot shaft 36 for folding the support legs together, as is conventional. Each pivotal joint has two cylindrical end portions for mating with tubular support legs. For example, as shown in the figure, the first pivotal joint 32 can be mated with a first upper leg support 38 and a first lower leg support (not shown), while the second pivotal joint 34 can be mated with a second upper leg support (not shown) and a second lower leg support 40.

Each of the upper and lower leg supports consists of, e.g., a hollow leg tube through which is threaded a stretchable cord 42. Other leg support structures will be described later in the discussion. The stretchable cord in each leg tube is connected between the cylindrical portion of the corresponding pivotal joint and some point in the tube, for example, either an upper connector 44, lower ground cap 46, or other mechanism, depending on whether a given leg support is an upper leg support or a lower leg support. The stretchable cord this is connected between the pivotal joint and the leg tube to allow pivoting of the tube around the joint along the cord. As shown in the figure, the length of the stretchable cord for a given leg support is selected such that the cord can be stretched to disengage the leg support from a pivotal joint, upper connector, or lower ground cap.

With this configuration, the lower leg supports, e.g., 40 in FIG. 2, can be disengaged from the pivotal joint, pivoted around the joint at the stretchable cord connection between the leg and the joint, and folded upward to meet the corresponding upper leg supports, all while maintaining connectivity to the pivotal joint by way of the cord. Similarly, the upper leg supports, e.g., 38 in FIG. 2 can be disengaged from u upper connectors, pivoted, and folded back along the other chair portions. For exam shown in FIG. 3, upper leg supports 38*a*, 38*b* can be disengaged from upper connectors 44*a*, 44*b* and folded back under the seat portion 14 of the chair 10. Connection of the upper leg supports to the upper connectors is maintained even after disengagement, again by virtue of the stretchable cords connected through the leg supports.

In a similar manner, the chair back portion 20 can be disengaged from the chair seat portion by disengaging the chair back side braces 22, 24, from chair back connectors 48*a*, 48*b*, respectively. As with the leg supports, each chair back side brace is threaded with a stretchable cord, here connected between the corresponding chair back side brace and a point along the brace, e.g., a side brace end cap 45*a* or 45*b*. As indicated by the arrows, upward pulling on the chair back side braces disengages the braces from the chair back connectors. The chair back can then be pivoted around the connectors at the stretchable cords and folded downward to the chair seat portion, all while maintaining connectivity to the chair back connectors by way of the stretchable cords.

Also indicated by arrows in the figure, the chair seat side braces and chair back side braces can be pulled toward each other by virtue of the scissor leg supports such that the four side braces are in parallel and the chair seat and back portions are folded on themselves. Then, with the leg support disengagement and folding sequences given above, the leg supports can also be folded under the chair seat portion to join the parallel group of side braces.

Figure 4:
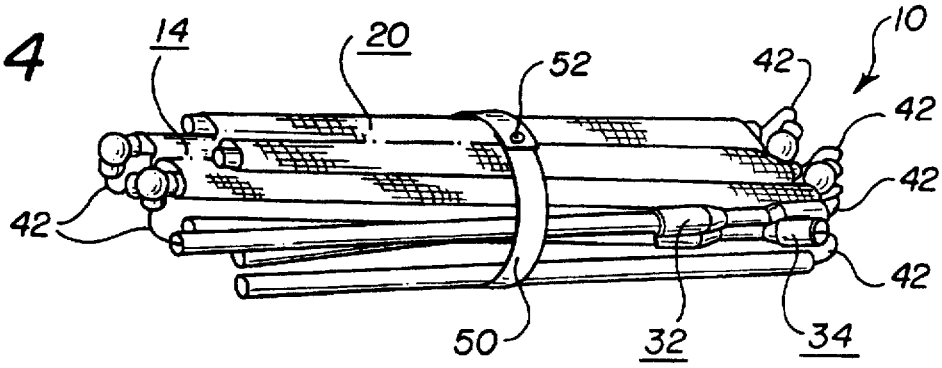
FIG. 4 is a perspective view of the chair of FIG. 1A when folded, collapsed, and bundled in accordance with the invention.

Once the side braces and leg supports have been folded together in this manner, the entire chair is collapsed, as shown in FIG. 4, into a very compact bundle of braces, leg and other supports, and pivotal joints. The chair back portion 20 can then be wrapped around the bundle and secured with, e.g., a strap 50 that extends around the entire bundle as shown or, alternatively, simply connects between ends of the chair back portion. A snap 52, hook and eye combination, or other means for securing ends of the strap are preferably provided, as in the manner of, e.g., an umbrella, to maintain the compact bundle.

Note in FIG. 4 that the various braces, supports, and joints are either mated to each other or are connected by way of a stretchable cord 42. Thus, even when the chair is in a fully collapsed and folded configuration, the chair components remain intact in geometric relation to each other. This collapsed connectivity results in no loose chair components and thus ensures that no component is forgotten or lost during the collapsing process. Furthermore, the collapsing process requires only tube disengagement and folding, without the need for physical disassembly. The tension of the connectivity cords urges the collapsed components together to maintain them in a compact bundle for storage and transport. The collapsible connectivity folding mechanism of the invention thereby addresses the needs for simple collapsible furniture that can be configured in a very compact storage configuration.

The collapsible connectivity folding mechanism of the invention can be applied to any furniture configuration for which it is desired to collapse leg and other support structures together into a compact bundle. For example, as described later in the discussion, leg supports other than X-shaped scissor legs can be configured as tube structures for folding together various leg portions. Indeed, a given leg support can include any number of foldable leg portions, each consisting of a tubular section having a stretchable cord threaded through it. Likewise, any number of upper and lower connectors and side braces, if included at all, can be configured such that leg supports remain attached to the connectors by way of stretchable cords even when the leg supports are disengaged from the connectors and side braces.

Many other important advantages are provided by the collapsible furniture of the invention beyond the advantages of the collapsible connectivity folding mechanism. Each will be described in turn, using the chair of FIG. 1A as an example. As will be recognized, this is but one example of the many furniture configurations contemplated by the invention.

Figure 5:
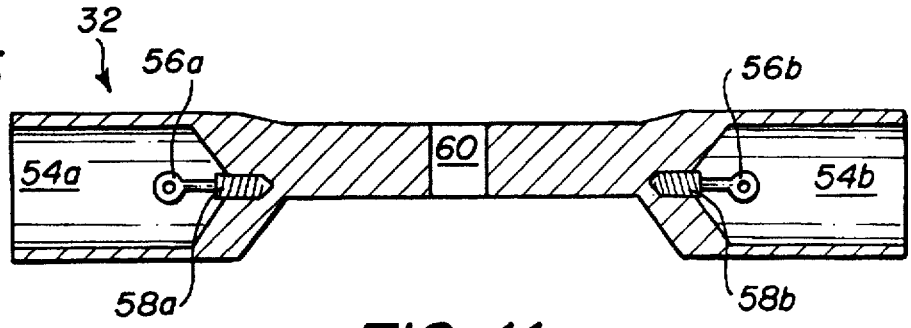
FIG. 5 is a cross-sectional view of a pivotal joint configuration in accordance with the invention.

Referring again to FIG. 1A, in a furniture piece such as a chair that includes an X-shaped scissor leg configuration, the scissor action can be provided by, e.g., pivotal joints, as shown also in FIG. 2. An example pivotal joint 32 is shown in detail in FIG. 5. As explained earlier, the pivotal joint includes cylindrical end portions 54*a*, 54*b* for each accepting a mating leg. Each cylindrical end portion has an eyelet 56*a*, 56*b* for attaching an end of a stretchable cord to the pivotal joint. In one example configuration, as shown, the eyelet is provided on the end of a screw 58*a*, 58*b* that is threaded into the cylindrical end portion. A stretchable cord can be tied to the eyelet or, as is easily recognized, another suitable connection means can be employed to connect the cord to the pivotal joint.

The pivotal joint includes at its midsection a hole 60 for securing to a second pivotal joint to form an X-shaped support structure; in one configuration, the midsection is about 0.4 inches in thickness. The pivotal joints can be formed of any metal, plastic or even wood. Preferably, the pivotal joints are formed of a strong and lightweight material such as lightweight aluminum. Alternatively, the joints can be formed of injection molded plastic. The joint eyelet can be formed of die-cast steel or other suitable material.

As shown in FIG. 2, two pivotal joints are secured together by way of, e.g., a pivot shaft 36. In the X-shaped scissor leg support configuration, the pivot shaft can under some usage conditions support substantially the entire stress applied to the lower leg supports, and therefore, the shaft should preferably be formed of a means that can bear a force of, e.g., about 200 megapascals. Preferably, the shaft is formed of a metal such as aluminum, titanium, or steel. A bolt and wing nut combination, mated bolt-sleeve combination, flared bolt configuration, or other conventional shaft configuration can be employed.

Turning now to the leg supports, these can be formed of hollow support tubes, as described above, or alternatively, formed of solid shafts or other suitable configuration. The only requirement of the leg supports is that they provide some mechanism for securing a stretchable cord between the supports and a corresponding joint around which they are to pivot for collapsing the chair. For some applications, hollow support tubes may be preferable to minimize the chair weight. In this case, the diameter of the leg tubes and the tube wall thickness is preferably selected based on an expected support weight capability desired for a given application of the furniture, to maximize the strength of the chair for a minimum tube wall thickness.

For example, in the case of a chair, the expected seating weight that could be applied to any single leg is preferably accommodated by the leg tube geometry. In one example, each chair leg is allotted a 400 pound support capacity. This weight value accounts for application of the entire weight of a 200 pound person on a single chair leg, a scenario that can occur during seating. In such a scenario, the person's entire weight, as well as downward momentum forces associated with the chaotic nature of seating, can be focused on one chair leg. As a result, a weight of about 400 pounds is preferably accommodated by each leg for seating of a 200 pound person.

The leg tube outer diameter and wall thickness for a given seating weight is then determined based on a relationship requiring that the total stress, $\sigma_{total}$, on a leg not exceed the yield stress, $\sigma_{yield}$, for a selected leg material, with a safety factor, SF, includes:

$$\sigma_{total}=\sigma_{compressive}+\sigma_{bending}\leq\sigma_{yield}/SF; \quad (1)$$

where the compressive stress, $\sigma_{compressive}$, is given as:

$$\sigma_{compressive}=F_{applied}\cos(\theta)/A, \quad (2)$$

given that $F_{applied}$ is the total of weights and forces applied to a leg, θ is the angle, with respect to the vertical, at which a leg is angled, and A is the cross sectional area of a leg, given as:

$$A=\pi(r_{outer}^2-r_{inner}^2), \quad (3)$$

with $r_{outer}$ defining the outer leg tube radius and $r_{inner}$ defining the inner radius of the tube. The bending stress, $\sigma_{bending}$, included in relation (1) above is given as:

$$\sigma_{bending}=-My/I, \quad (4)$$

where M is the bending moment, y is the vertical coordinate along the leg, and I is the second moment of inertia, given as $$I=\pi(r_{outer}^4-r_{inner}^4)/4. \quad (5)$$

A further consideration of the leg tube geometry must be given to the load weight that would cause buckling. The critical buckling load, $P_{critical}$, for a given leg material is given as:

$$P_{critical}=20.13EI/L^2, \quad (6)$$

where E is Young's modulus for the given material, I is the second moment of inertia of the leg tube, as given above in relation (5), and L is the length of the leg tube. This relation assumes that the leg tube acts like a cantilever that is allowed to move freely at one end.

Given these stress and buckling criteria, the corresponding leg tube inner and outer radii can be determined for a given leg tube material. The leg tubes can be formed of, e.g., fiberglass, polyvinylchloride tubing, carbon fiber composites, aluminum, titanium or other metal such as steel. Considering the portability feature desired for the collapsible furniture, a material having a high strength to weight ratio is preferable. For example, carbon fiber is preferable over conventional metals because of its high strength and very light weight. Given the use of carbon fiber as the leg tube material, and given a lower leg support tube length, L, of about 0.38 meters, with a safety factor, SF, in relation (1) above set at 1.5, relations (1) through (6) above suggest that the carbon fiber leg tube should have an outer radius of about 8.94 mm and an inner radius of about 7.94 mm, for a wall thickness of about 1.0 mm. This configuration provides a maximization of strength and a minimization of tube wall thickness. Well above 400 lbs can be withstood by a carbon fiber leg tube having this geometry and angled at any of 51°, 45°, or 40°. Due to the high cost of carbon fiber, other materials may be found preferable for some applications.

As will be recognized by those skilled in the art, the relations given above can be adapted to reflect a given application for a wide range of furniture configurations provided by the invention. For example, the relations can be adjusted to reflect the stresses and forces that should be accommodated by tables, cots, foot rests, or other furniture structures. Of course, the selection of leg support structure has a large impact on the geometric focus of stresses on a given furniture configuration. Leg structures other than the X-shaped scissor leg structure can be employed and can be correspondingly modeled to ascertain the preferable leg tube geometry for a given furniture configuration.

Turning back to the scissor leg configuration for the chair of FIG. 1A, the lower leg sections of the X-shape support structure are preferably formed of longer structures than that of the upper leg sections of the X-shape. This geometry produces a wider support base and correspondingly more stable support base for the chair. The lower leg section length can also preferably add to the ergonomics of the chair when collapsed; when disengaged from the pivotal joint and folded up to the upper leg section, the lower leg section preferably is of the same length as that of the pivotal joint and upper leg section combined. This results in a neat bundle of components when the chair is completely collapsed.

The chair seat side braces 16, 18 and chair back side braces 22, 24 can be formed of the same material, e.g., tubing, used for the leg support sections. Indeed, for ease of manufacture, a single length of tubing can be cut into multiple sections to form the various legs and side braces, each of any selected length.

The stretchable cords threaded through the leg and side brace tubes are preferably formed of a rugged elastic material of a thickness less than that of the tube inner; the cord thickness should be small enough to accommodate pivoting of a tube section substantially through 360°. Each cord preferably includes at each of its ends some mechanism for securing the cord to, e.g., an eyelet provided in the pivotal joint or the upper chair supports. As will be easily recognized, however, the cords can be tied, screwed, hooked, or connected by some other suitable means to the joint and chair supports. Given that the cords function to maintain the chair components under tension and engaged in their corresponding connection sockets, the cord length to be used with a given tube is selected to produce the desired tension so that, whatever their dimensions, the cords preferably produce a reasonable amount of tension and eliminate any slack between the components when the chair is in its set-up position.

As mentioned above, various leg support structures are contemplated by the invention, and accordingly, various stretchable cord configurations can be employed. For example, in one configuration, the lower leg supports consists of hollow tubes and stretchable cords are threaded through the entire tube length and secured, as shown in FIG. 2, onto end caps 46, e.g., rubber stoppers. The end caps also enhance stability of the leg support tubes. An eyelet can be affixed to each end cap by, e.g., a nut and bolt combination for hooking or tying a cord to the end cap or alternatively, a disk can be located in the bottom of the stopper that supports an eyelet.

During use of the chair, one or more of the chair's lower leg support tubes may be tipped on-edge such that the tubes are in contact with the ground at an angle. This scenario results in a focusing of pressure on only the portion of the tube circumference that is in contact with the ground. Under some conditions, it is possible that such focused stress could result in collapse of that tube circumference portion. It is thus preferable to include a stress distribution mechanism on the bottom of the lower leg support tubes such that the stress of a tube portion on-edge is distributed to other portions of the tube circumference.

Figure 6:
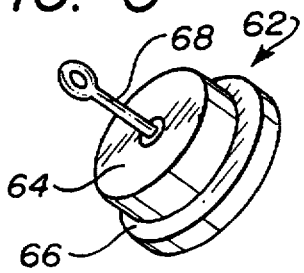
FIG. 6 is a disk end cap provided by the invention.

For example, referring to FIG. 6, a cylindrical insert 62 can be provided for mating with the leg support tube to distribute pressure around the circumference of the tube. The insert can consist of, e.g., a first disk 64, corresponding to the tube's inner diameter, and connected to a second disk 66 corresponding to the tube's outer diameter. An eyelet 68 can be provided on the first disk as a means for connection to the stretchable cord threaded through the leg support tube. The insert can be formed of, e.g., metal, preferably aluminum, or other suitable material, including wood. The insert can be directly mated into the lower leg support tube or mated into the leg end cap. Other stress distribution mechanisms can alternatively be employed. For example, a brace, strip, or other structure can be employed for connection between points of the support tube to distribute stress around the tube circumference.

Figure 3:
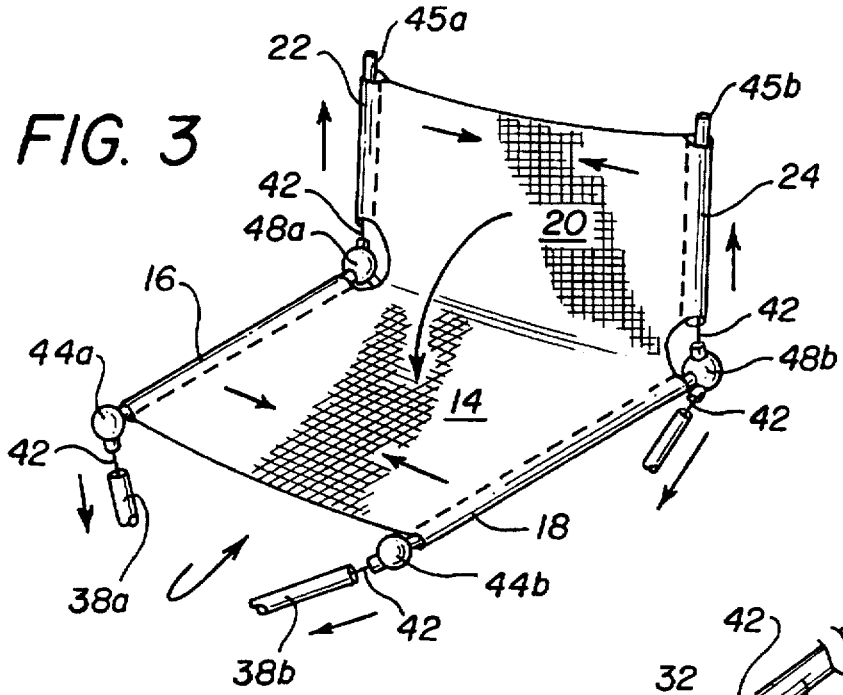
FIG. 3 is a perspective view showing details of the chair of FIG. 1A.

As shown in FIG. 3, the chair back side braces 22, 24, can also be formed of hollow tubes. In this case, end caps 45*a*, 45*b*, consisting of, e.g., rubber stoppers like that used on the lower ends of the lower leg support tubes described above, can be employed for securing stretchable cords to the tubes. The side brace end caps can include eyelets secured by, e.g., nut and bolt combinations or, as just described, disk inserts having attached eyelets can be engaged in the ends of the brace tubes.

Figure 7A:
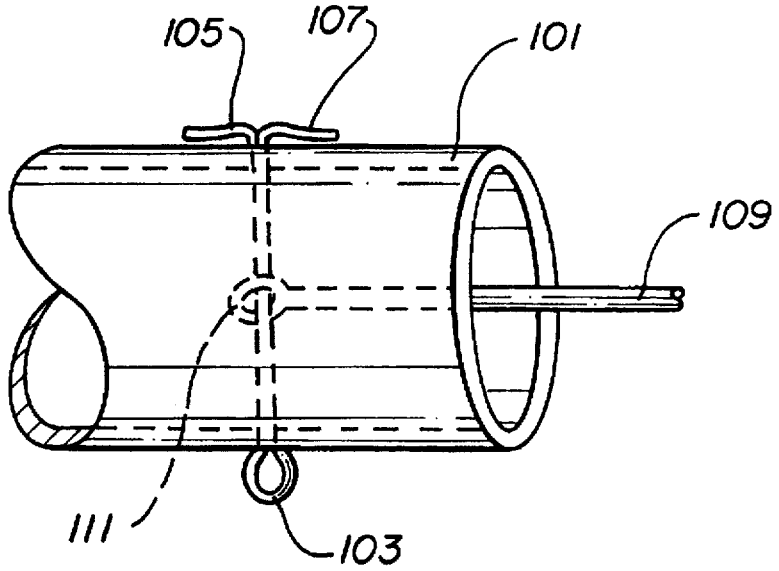
FIGS. 7A–7C are schematic views of three stretchable cord connection configurations provided by the invention.
Figure 7B:
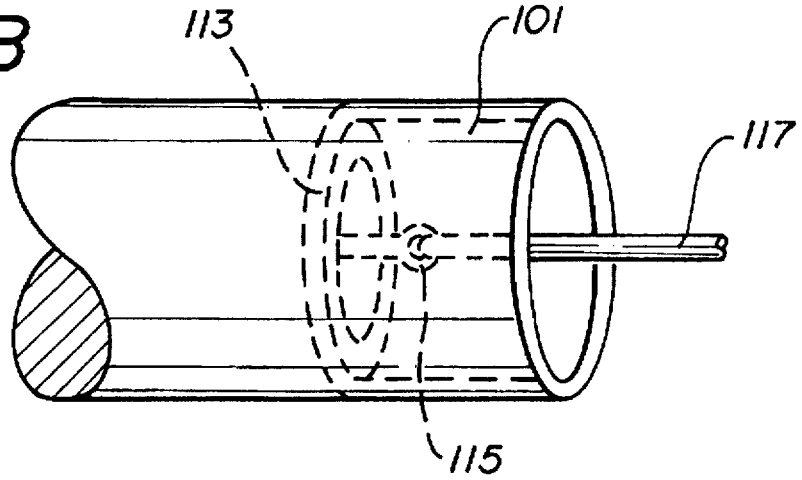

Other leg and brace section configurations and cord attachment mechanisms are provided by the invention. Referring to FIG. 7A, in one example, leg and/or brace sections are provided as hollow tubes 101, and a cotter pin 103 is employed for securing a cord 109 in the tube at a point along the tube length. The cotter pin is here inserted through parallel holes drilled in the tube wall and the pin legs 105, 107 are secured at the outside of the tube wall. The cotter pin can be slid through a hook 111 provided at the end of the cord 109, as shown, or alternatively, the cord can be tied around the pin. The cotter pin can be located at any point along a tube length, e.g., near to the joint around which the tube is to pivot. This configuration requires less cord material than would be required to thread a cord through the entire length of a tube. As can be understood, only tube materials that are sufficiently robust to accommodate holes drilled in the tube walls should be employed in this configuration. Carbon fiber may not sufficiently withstand such holes, while aluminum can effectively accommodate the configuration.

In a second alternative example for securing a stretchable cord at a point along the length of a hollow tube, an inverted disk cap 113 is inserted into a tube 101 and securely fixed within the tube using, e.g., glue or epoxy. The disk cap 113 includes an eyelet 115 or other similar hook, for hooking or tying a stretchable cord 117 to the hook. The disk cap can be positioned a short depth in the tube to minimize the length of cord needed for a given tube.

Figure 7C:
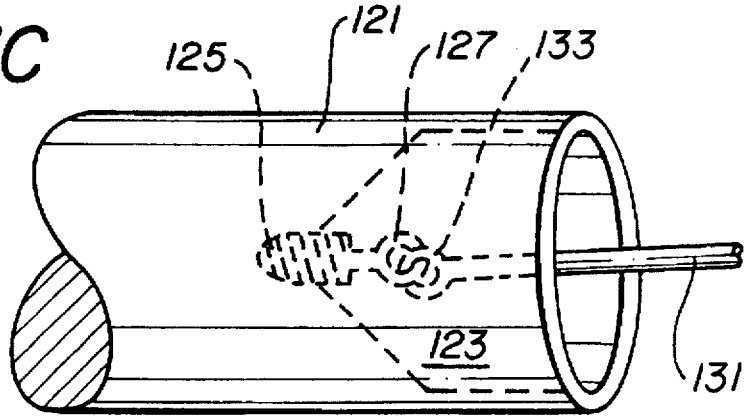

The leg and brace sections of the chair can also be formed of solid shafts rather than hollow tubes. Referring to FIG. 7C, in one example of a solid shaft leg section 121 provided by the invention, a cavity 123 is included in the leg section. The cavity provides a threaded hole in which a threaded screw 125 can be secured. An eyelet 127 or other mechanism is provided on the end of the threaded screw for attaching to an eyelet 133 on the end of a cord 131, or for tying the cord 131 to the screw eyelet 127. With this configuration, a stretchable cord can be attached between a solid leg or brace section and joint to allow the section to pivot around the joint on the interconnecting cord. The solid leg section can be formed of any suitable metal, composite, plastic, or wood; the weight bearing capability of any given material must be evaluated, however, for its suitability.

These examples are but a small number in the wide range of leg and brace support structures and cord connection mechanisms contemplated by the invention. No specific support structure or cord connection mechanism is required; instead, all that is required is a provision for securing an elastic cord between given support and joint structures to enable pivoting of the support structure around the joint on the elastic cord for collapsing the chair or other furniture configuration in which they are included.

Figure 8:
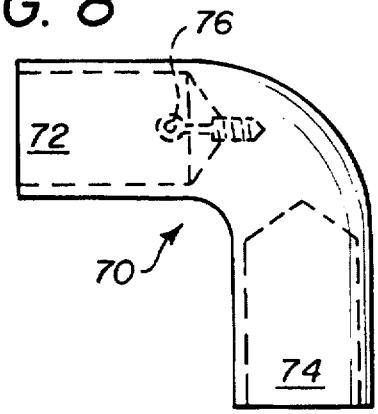
FIG. 8 is an example double-socketed joint configuration in accordance with the invention.

Referring now in further detail to FIG. 3, the upper leg supports of each leg scissor pair, e.g., 38*a*, 38*b*, are engaged with upper connectors 44*a*, 44*b* that consist of, for example, double-socketed joints. An example double-socketed joint in the form of an elbow joint 70 is shown in FIG. 8. The elbow joint includes cylindrical sockets 72, 74, for engagement with an upper leg support and a chair seat side brace, respectively. The angle between the two sockets is preferably about 90°. Recall that the upper leg supports are connected to the elbow joints by way of a stretchable cord for disengagement and folding of the leg supports, while the seat side brace is intended to remain engaged in the elbow joint. Thus, only the socket corresponding to the leg support is provided with an eyelet 76 or other means for securing a length of stretchable cord to the elbow joint socket 72.

The elbow joint can be formed of any metal, e.g., preferably aluminum, given its light weight and relatively low cost. The thickness of the joint walls are preferable selected to withstand the maximum bending stress expected for a given furniture configuration. Given an aluminum joint wall thickness of between about 0.005–0.008 inches in thickness, the bending stress required to exceed the yield strength of the aluminum joint is determined to be more than about 57,000 Newtons, based on relation (4) above. Thus, a relatively thin aluminum joint can support a high level of stress.

However, the aluminum joints could be deformed if they were stepped on; such deformation would be permanent, and would render an aluminum joint useless. It is thus preferred to use injection molded high density plastic for the elbow joints—polystyrene and other similar high density plastics would not likely be permanently deformed under pressure from being stepped upon. With the use of a plastic joint, a threaded metal insert can be integrated into the molded part to provide internal threads that enable threading of an eyelet screw into the corresponding joint socket.

Figure 9:
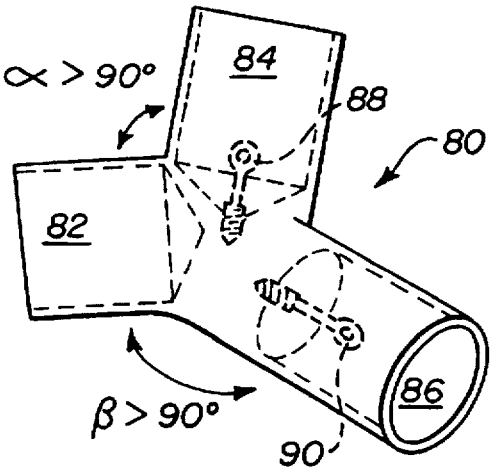
FIG. 9 is a first example of a triple-socketed joint configuration in accordance with the invention.

At the back of the chair seat portion, two triple-socketed joints 48*a*, 48*b* in FIG. 3, are provided for connection to upper leg supports 46, chair seat side braces 16, 18, and chair back side braces 22, 24. A first example triple-socketed joint 80 is shown in FIG. 9. The joint includes a first cylindrical socket 82 for engagement with a chair seat side brace, a second cylindrical socket 84 for engagement with a chair back side brace, and a third cylindrical socket 86 for engagement with an upper leg support. Recall that the chair seat side braces are intended to remain engaged with the joint, while the chair back side braces and upper leg supports are disengaged and folded about the joint using stretchable cords threaded through the tubes. Thus, the second and third sockets 84, 86, are provided with corresponding connection means such as eyelets 88, 90 for connection to stretchable cords. Such eyelets can be provided on the ends of threaded screws, as shown, or using a configuration like that of FIG. 6, a disk insert 62 can be employed in each socket.

The angular relation between the three joint sockets is selected based on considerations for comfort and stability of the chair. For example, the angle, α, between the socket 82 for the seat side brace and the socket 84 for the seat back side brace is preferably greater than 90°, and more preferably at least about 100°, to provide a comfortable and natural reclining position of the seat back for a person sitting in the chair. The seat back can alternatively be angled at about 90° for using the chair, e.g., at a table. The triple-socketed joint of the invention accommodates a custom seat back orientation to provide a level of seating comfort not typically associated with collapsible portable chairs that stand above the ground.

The angle, β, between the socket 82 for the seat side brace and the socket 86 for the upper leg support is preferably also greater than 90°, e.g., about 95°, to give stability to the chair leg support. In other words, an increased angle beyond a right angle between the chair seat and legs at the rear of the chair seat adds a degree of stability to the support structure that is not typically associated with collapsible portable chairs that stand above the ground.

Figure 10:
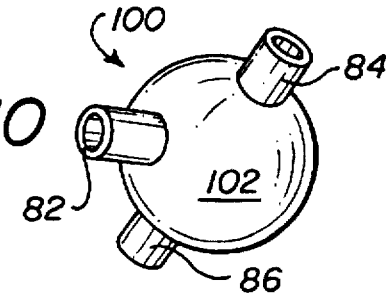
FIG. 10 is a second example of a triple-socketed joint configuration in accordance with the invention.

The triple-socketed joint 80 can be formed of an aluminum elbow joint to which a third socket is welded. This may not be preferable in some cases, however, due to the general imprecision of welding procedures, as well as the deleterious effects of the welding heat on the aluminum. The invention provides a triple-socketed spherical joint 100, shown in FIG. 10, that overcomes this limitation of welded joint configurations. The spherical joint 100 consists of a conventionally sand-case aluminum sphere 102 into which holes are drilled at appropriate angles for fitting aluminum socket tubes 82, 84, and 86 into the sphere. The socket tube orientations are here selected as above to provide a desired degree of chair comfort and stability. Eyelet or other cord attachment means are provided in the corresponding socket tubes.

The spherical triple-socketed joint is particularly preferably because in its configuration, stress applied to the joint is substantially focused at the center of the sphere, rather than at the tube sections or intersection of tube sections with the sphere; accordingly, a high degree of bending stress can be accommodated by the joint. Given this advantage, the spherical joint design is preferably also applied to the double-socketed joint employed at the front of the chair for many applications. Indeed, any reasonable number of joint sockets can be accommodated by the spherical joint design. As will be recognized by those skilled in the art, other joint configurations and materials are also acceptable. For example, injection molded high density plastic spherical joints are preferable for their light weight and resiliency under deforming stresses. A particular joint configuration and material is thus selected based on the particular application for a furniture piece pursuant to the invention.

Turning again to FIG. 3, the chair seat side braces are in one example configuration intended to remain engaged in the double-socketed front joints and rear triple-socketed joints when the chair is collapsed and folded. The side braces can be fixed in place in the joints by, e.g., welding, epoxying, threading, gluing, or other fixing mechanism suitable for the combination of brace and joint materials being used. Alternatively, if the braces and joints are formed of the same material, they can be formed as one continuous piece. For example, injection molding processes can be employed to form brace tubing and elbows of unitary high density plastic construction.

Figure 11:
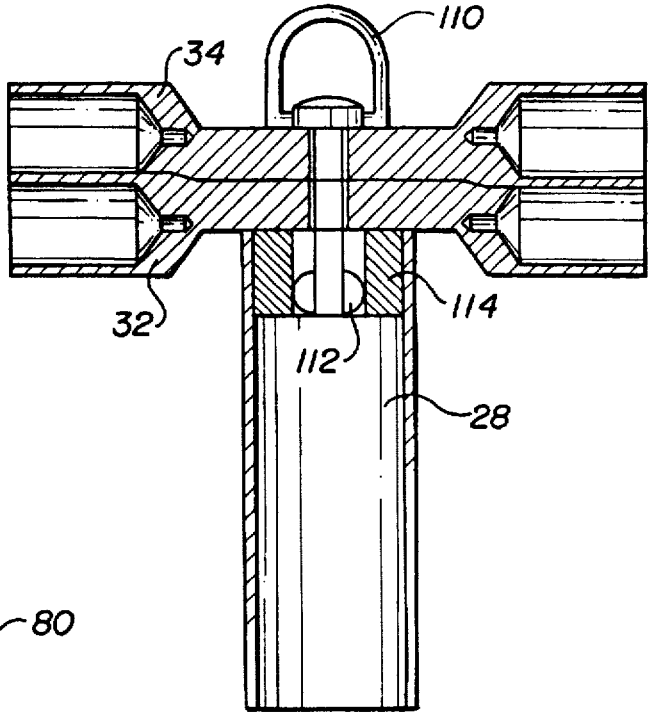
FIG. 11 is a cross-sectional view of two pivotal joints and a cross brace configuration in accordance with the invention.

As shown in FIG. 1B, a stool, or other furniture structure pursuant to the invention, can include a cross brace 28 connected between two X-shaped scissor support structures 26. The cross brace can be used to add strength and stability to the support structures for applications requiring extremely high strength. FIG. 11 shows a connection technique for configuring two pivotal joints with such a cross brace. The cross brace 28 and pivotal joints 32, 34 are secured by, e.g., a quarter-turn fastener 110 having end fins 112. A fastening channel 114 is provided in the brace for anchoring the fastener fins in place. This fastening scheme can be used on both scissor support structures to hold the brace firmly in line between the structures. As will be easily recognized, other fastening configurations can alternatively be employed.

When collapsing and folding a stool or other furniture structure that includes a cross brace, the brace is preferably removed at the start of the collapsing procedure. Once the furniture is collapsed, the cross brace can be stored as a separate, unconnected component with the bundle of interconnected legs, braces, and joints, or alternatively, can be connected to one of the leg support structures by, e.g., a dangling connecting cord. However, because the brace is not integrally connected under tension by a stretchable cord to other of the furniture components, and therefore reduces the compactness of the collapsed and bundled furniture, it is preferred that the brace not be included in a furniture structure unless its strength enhancement is necessary for a given application.

Turning to the other components of the chair and stool shown in FIG. 1, the seat portion 14 of the chair and stool is a durable material selected for a given application of the furniture. For example, for outdoor use of the furniture, the seating material preferably is weather-proof and not photo- or bio-degradable. Nylon or other water-resistant fabrics are good candidates for this application. Considerations of weight are also important for use in which the furniture is to be transported on foot—a lightweight fabric is in this case preferable. If the furniture is to be used in-doors or under a shelter, almost any fabric can be used; heavy weight cotton or other upholstery fabric can thus be employed. In general, any fabric to be considered must meet a minimum strength requirement for the intended use of the furniture.

A chair back portion 20 can be provided as a separate piece of fabric or more preferably, provided as a continuous extension of the chair seat fabric. A continuous extension between the chair seat and chair back aids in maintaining the seat and back in alignment when the chair components are collapsed and bundled in the chair back portion, and holds the chair back portion in place such that it does not slide off the chair component bundle.

At the location of the rear support triple-socketed joints (**48*a*, 48*b* in FIG. 3**) the chair seat and chair back portions are flared inward of the joints to accommodate the various leg and brace support connections. Both the chair seat and chair back provide end loops of fabric for extending over the seat side braces and back side braces. The fabric loops are formed by stitching a seam in the fabric to produce a fabric tube having a diameter slightly larger than that of the braces, whereby the fabric loops can be easily slipped over the braces but are not overly loose around the braces. Preferably, the loop seam is double stitched with heavy-duty thread to add strength to the seam. The ends of the seat and back portions are also preferably finished off with double stitching.

As with the chair seat and back portion fabric selection, the sizes of the chair seat and back portions are selected based on criteria for weight, as well as on criteria for comfort and for the desired size of the chair when collapsed and bundled. Unlike typical collapsible furniture, the collapsible folding furniture pursuant to the invention accommodates full-size furniture features that can be very compactly collapsed when bundled. For example, in one chair configuration, the chair seat is of a depth of between about 8 inches and 18 inches and a width of between about 14 inches and 25 inches; the back is of a height of between about 4 inches and 12 inches, and a width corresponding to that of the chair seat. As can be recognized, other chair seat and back dimensions are contemplated by the invention. If no chair back is to be used, as in the stool of FIG. 1B, the seat portion 14 is accordingly sized for comfort.

The leg support configurations for the chair are also selected based on criteria for comfort and desired size of the collapsed and bundled chair componentry, as well as to achieve a desired seating height. Due to the folding mechanism provided by the invention, full-size seating height can be accommodated by the collapsible folding chair. In one example configuration, the lower leg supports are about 15 inches long and the upper leg supports are about 12 inches long. The upper and lower leg support lengths determine the seating height of the chair based on their support configuration. For an X-shaped scissor leg configuration like that shown in FIG. 1, a seating height of more than about 20 inches can be accommodated. Thus, as can be recognized, any reasonable seating height can be selected; if desired, the seating height can be quite low to the ground, e.g., for a child's chair, or alternatively, a very large seating height can be provided for a tall person's chair.

The folding mechanism provided by the invention can be employed to accommodate any reasonable number of leg supports such that a desired seating height is achieved. For example, either or both the upper and lower leg sections of a scissor support structure can include two or more individual leg support tubes; the various tubes can be folded over each other when the chair is collapsed such that a very compact bundle of interconnected leg sections is achieved. Thus, both seating comfort and compact portable size are provided by the chair configuration of the invention.

As described earlier, not only the chair leg support sections, but also the chair back portion are folded when collapsing the chair for storage or transport. Reviewing this collapsing procedure, as partially shown in FIG. 3, an opened chair is collapsed by first pulling the chair back side braces 45*a*, 45*b* out of the rear triple-socketed joints 48*a*, 48*b* to stretch the cords 42 in the side braces and disengage the braces from the joints' sockets. The chair back 20 is then folded down to meet the chair seat 14. At this point, the chair seat side braces 16, 18 are brought together side-by-side by scissoring the legs of the chair together. Then, the lower leg support tubes (40 in FIG. 2) are disengaged from the respective pivotal joints by pulling the lower leg support tubes downward. The disengaged lower leg tubes are then folded up to meet their respective upper leg support tubes, i.e., folded together with the upper leg support tube in the same diagonal line.

Next, the front upper leg support tubes 38*a*, 38*b* in FIG. 3, are disengaged from the double-socketed joints 44*a*, 44*b*. The back upper leg support tubes, e.g., 46, are also disengaged from the triple-socketed joints 48*a*, 48*b*. The front and rear upper and lower leg support tube pairs, now each folded on top of each other, are then folded up to meet the chair seat side braces 16, 18, and back side braces 22, 24, which are all folded together in parallel. At this point, all of the braces, leg support tubes, and joints are aligned in parallel and are in a compact bundle due to the tension of the cords interconnecting the components.

The seat and back portions of the chair are then wrapped around the bundle of components, and as shown in FIG. 4, the strap 50 is secured for storage and transport of the bundle. Of course, other bundling closures, or a carrying bag or case can alternatively be employed.

A particular advantage of the tensioned component connection scheme provided by the invention is the ease with which chair set-up is accomplished. Because the chair includes no loose parts, no assembly of parts is required. Instead, the chair automatically assumes its set-up position once the components are unbundled. Specifically, the chair is set up by unsecuring the strap around the bundle and holding the chair seat side braces at a distance above the ground. With this motion, leg support tubes and seat back braces are automatically pulled into the corresponding joint sockets, such that the chair configuration is self-assumed, due to the pivot action of the stretched interconnection cords. If a leg support tube or brace does not entirely engage the corresponding joint socket, all that is required is a light tap to produce the desired socket-tube alignment. Then, the chair seat side braces and back side braces are pulled apart to fully set up the chair. This very quick and simple set up process eliminates the time consuming complexity typically associated with collapsible furniture assembly.

The invention contemplates a wide range of collapsible folding furniture employing stretchable cord interconnections for collapsing and bundling. For example, the structure shown in FIG. 1B can be adapted to form a table, foot rest, work surface, cot, lean-to, or other configuration. The length of the leg support tubes and side braces are selected based on the given application. As explained earlier, the cross brace 28 shown in FIG. 1B is optional and not required by the invention. As can be recognized, many furniture configurations can be accommodated by the connection technique of the invention.

Figure 12:
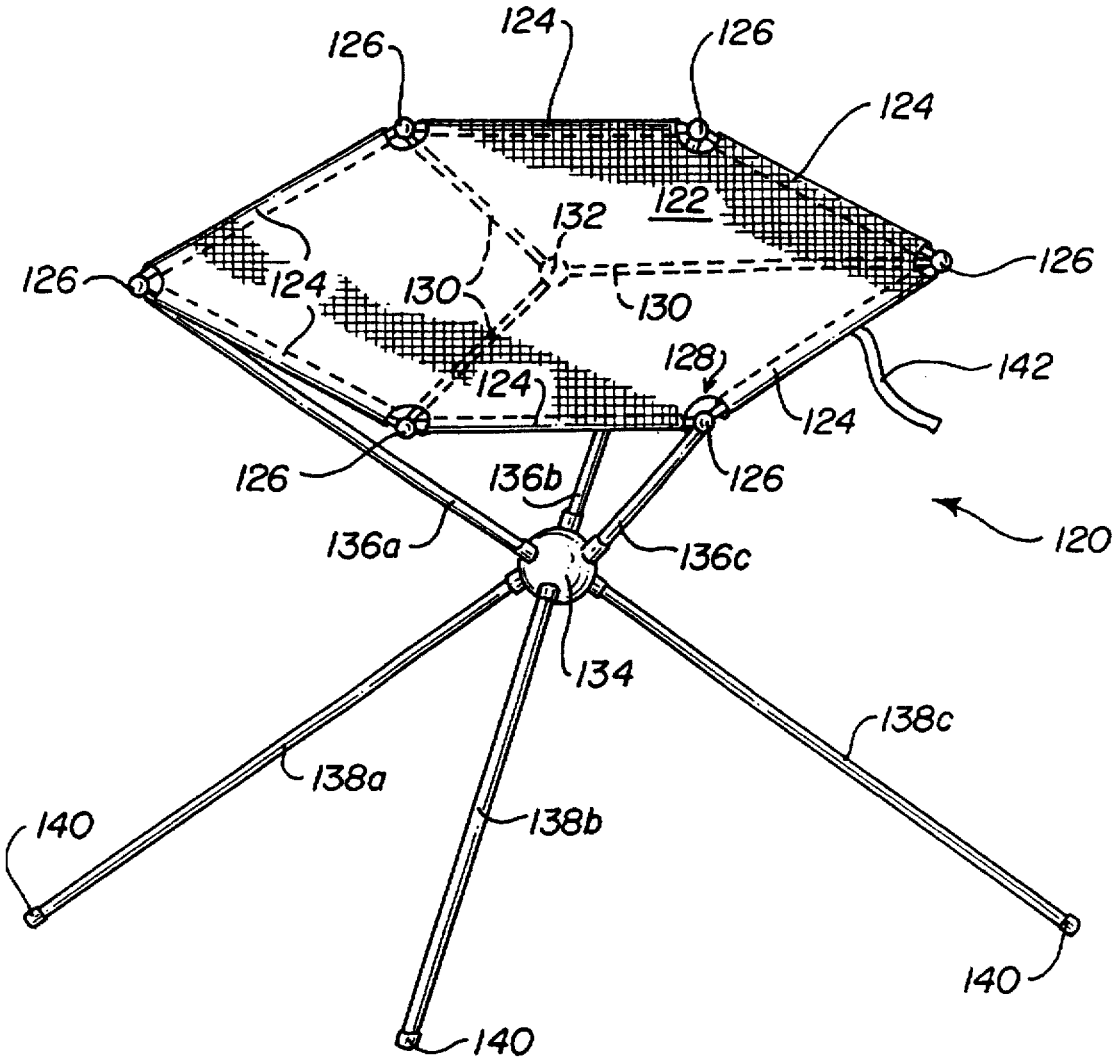
FIG. 12 is a perspective view of a table configuration in accordance with the invention.

Leg support structures other than the scissor leg support structure described above are also accommodated by the invention. Referring to FIG. 12, there is shown a table 120 having a six-socketed leg support joint 134 for a three-legged table. The table is a hexagonal surface 122 having six side braces 124 around its periphery. Each of the side braces 124 are connected to a corresponding triple-socketed joint 126. The table surface 122 is flared inward 128 at the location of the joints 126 to accommodate the sockets. Each of three of the triple-socketed joints supports a horizontal brace 130 connected to a central joint 132 under the table surface 122.

Each of the other three triple-socketed joints supports an upper leg tube 136*a*, 136*b*, 136*c*. These upper leg tubes are in turn engaged in the six-socketed leg support joint 134. Three lower leg tubes 138*a*, 138*b*, 138*c* are engaged in the six-socketed leg support joint and rest on the ground on end caps 140 like those described earlier. Preferably, the span of the table legs is wider than the table surface span to enhance the table's stability. As can be recognized, leg supports of other configurations, e.g., solid shafts, as well as various stretchable cord securing mechanisms, e.g., a corer pin fastening scheme as described above, can be employed.

The hexagonal table, while providing full-size surface and height features, can be very compactly collapsed. This is enabled by virtue of connection of the leg tubes and braces to the various joints by stretchable cords in the manner described above. Collapsing of the table is accomplished by disengaging the lower leg tubes from the six-socketed joint and folding the lower leg tubes up to the upper leg tubes. The upper leg tubes are then disengaged from the six-socketed joint and the paired upper and lower leg tubes are folded up to the table surface. The horizontal braces 130 are then disengaged from the center joint 132 and each folded to a corresponding side brace. Then two opposing side braces are disengaged from one of their connecting joints and the table surface is folded in half. This is repeated with two other braces, and the surface is then again folded like a triangle. At this point, the leg tubes and braces are wrapped in the table surface and secured with, e.g., a strap 142. Set-up of the table is very quick, requiring only the unfolding of the table surface and alignment of the various braces and legs and their corresponding joints.

As can be recognized, many other furniture structures can be adapted based on the tri-leg support structure of FIG. 12, as well as the other support structures discussed earlier. All that is required is that the legs of the structure be foldably collapsed by way of a pivot motion enabled by a stretchable cord connected between the legs and the corresponding joints. This enables a very compact collapsed size and maintains connectivity of all components, as well as resulting in a very quick and simple set-up process.

The furniture configurations provided by the invention, and particularly the chair and stool configurations, provide significant performance advantages over typical collapsible furniture. First, as just mentioned, the furniture can be collapsed into very compact dimensions. A collapsed chair or stool pursuant to the invention is no larger than a typical folded tent, e.g., about 3.5 inches in diameter and about 15–22 inches long, and thus can fit in a large purse or a backpack. No loose parts are incorporated into the bundle, thereby eliminating the chance of losing or forgetting parts during the folding process. The furniture is thus easily transported and can be carried in a bag or pack of equipment on a hike or camping trip. Indeed, several chairs can be easily carried together.

Even with a small collapsed size, the chair provided by the invention accommodates full-size seating and height features, and accommodates natural back reclining positions. Thus, unlike typical portable chairs, the chair provided by the invention allows a person to sit well above the ground in a comfortable recline. Tables, stools, cots, and other furniture pursuant to the invention can also provide full-size features. Selection of materials determines the furniture weight; for many applications such as transport on foot, it is preferable to minimize weight. For example, using carbon fiber leg and brace components, a chair pursuant to the invention can weigh as little as about 2.5 pounds, and using injection molded plastic joints, can weigh as little as 2.0 pounds. Of course, if weight is not a concern, heavier materials, such as aluminum, can be employed. The leg support and joint designs provided by the invention also enable significantly improved strength compared with typical portable furniture. For example, each leg of a chair pursuant to the invention and having carbon fiber legs can support over 400 lbs, as explained above. In addition, the leg and brace materials, joint materials, and support surface fabric can all be selected to provide durability and weather resistance. Finally, the ease of the furniture folding and collapsing procedures provided by the invention significantly enhance their adaptability for fast-paced activities.

From the foregoing, it is apparent that the collapsible folding configurations pursuant to the invention and described above not only provide comfortable, durable, lightweight, and strong portable furniture, but do so with designs that enable elegantly simple and quick set-up and folding, as well as providing a compact collapsed structure that has no loose parts. It is recognized, of course, that those skilled in the art may make various modifications and additions to the embodiments described above without departing from the spirit and scope of the present contribution to the art. Accordingly, it is to be understood that the protection sought to be afforded hereby should be deemed to extend to the subject matter claims and all equivalents thereof fairly within the scope of the invention.

I claim:

1. A collapsible support structure comprising:

a support surface extending between at least two side braces;

at least two leg supports for maintaining the support surface in a substantially horizontal position;

a separate socket joint corresponding to each leg support, each socket joint being slidingly engaged with an upper end of a corresponding leg support and engaged with an end of a side brace;

at least one of the sockets having an eyelet attached within the socket; and a separate elastic cord corresponding to each leg support, each elastic cord connected between a corresponding leg support and a corresponding socket joint eyelet and having a length selected to be in a state of tension when the corresponding leg support is engaged with the corresponding socket joint, as well as to enable the corresponding leg support to be disengaged from the corresponding socket joint and pivoted about the socket joint to the support surface while the cord remains connected.

2. The support structure of claim 1 wherein each leg support comprises a leg support tube, and wherein each elastic cord is connected to a corresponding socket joint by an eyelet in the socket joint.

3. The support structure of claim 2 wherein each elastic cord is connected to a corresponding support tube by a cotter pin in the support tube.

4. The support structure of claim 2 wherein each socket joint comprises a socket elbow joint.

5. The support structure of claim 2 wherein each leg support weight distribution means comprises a separate support tube end cap engaged at a lower end of each leg support tube, and wherein each elastic cord is threaded through a corresponding leg support tube and connected to an eyelet in a corresponding support tube end cap.

6. The support structure of claim 1 wherein each leg support comprises a solid shaft, and wherein each elastic cord is connected to a corresponding socket joint by an eyelet in the socket joint and is connected to a corresponding leg support shaft by an eyelet in a cavity in the shaft.

7. The support structure of claim 1 wherein the support surface is a flexible material sized to support a seated person.

8. The support structure of claim 1 further comprising a strap connected on an underside of the support surface, the strap having a fastening mechanism for securing the strap around a bundle consisting of the leg supports pivoted to the support surface and wrapped in the support surface.

9. A collapsible support structure comprising:

a support surface extending between at least two side braces;

four leg supports configured as two X-shaped scissor leg structures each of two leg supports, each of the two leg supports having an upper support and a lower support;

a separate socket joint corresponding to each leg support, each socket joint being slidingly engaged with an upper end of a corresponding upper support and engaged with an end of a side brace;

a separate elastic cord corresponding to each leg support, each elastic cord being connected between a corresponding socket joint and an upper support, and having a length selected to be in a state of tension when the corresponding upper support engaged with the corresponding socket joint, as well as to enable the corresponding upper support to be disengaged from the corresponding socket joint and pivoted about the socket joint to the support surface while the cord remains connected; and two pivotal joints, each pivotal joint engaged with a lower end of a corresponding upper support and slidingly engaged with an upper end of a corresponding lower support, a separate lower elastic cord connected between each lower support and a corresponding pivotal joint and having a length selected to be in a state of tension when the corresponding lower support is engaged with the corresponding pivotal joint, as well as to enable a corresponding lower support to be disengaged from a corresponding pivotal joint and pivoted about the pivotal joint to a corresponding upper support while the lower cord remains connected.

10. The support structure of claim 9 wherein each upper support comprises an upper support tube and each lower support comprises a lower support tube, and further comprising a separate support tube end cap engaged at a lower end of each lower support tube, wherein each lower elastic cord is threaded through a corresponding lower support tube and connected to an eyelet in a corresponding support tube end cap.

11. A collapsible support structure comprising:

a support surface extending between at least two side braces;

three leg supports each comprising an upper support and a lower support;

a separate socket joint corresponding to each leg support, each socket joint being slidingly engaged with an upper end of a corresponding upper support and engaged with an end of a side brace;

a separate elastic cord corresponding to each leg support, each elastic cord being connected between a corresponding socket joint and an upper support, and having a length selected to be in a state of tension when the corresponding upper support is engaged with the corresponding socket joint, as well as to enable the corresponding upper support to be disengaged from the corresponding socket joint and pivoted about the socket joint to the support surface while the cord remains connected; and a six-socketed joint engaged with a lower end of each upper support and slidingly engaged with an upper end of each lower support, a separate lower elastic cord connected between a corresponding lower support and the six-socketed joint and having a length selected to be in a state of tension when the corresponding lower support is engaged with the six-socketed joint, as well as to enable the corresponding lower support to be disengaged from the six-socketed joint and pivoted about the six-socketed joint while the lower cord remains connected.

12. The support structure of claim 11 wherein the support surface comprises a hexagonal surface sized as a table.

13. The support structure of claim 11 wherein each upper support comprises an upper support tube and each lower support comprises a lower support tube, and further comprising a separate support tube end cap engaged at a lower end of each lower support tube, wherein each lower elastic cord is threaded through a corresponding lower support tube and connected to an eyelet in a corresponding support tube end cap.

14. The support structure of claim 1 wherein the support surface comprises a rectangular surface sized as a table.

15. The support structure of claim 1 wherein the support surface comprises a rectangular surface sized as a cot.

16. The support structure of claim 1 wherein the support surface comprises a rectangular surface sized as a foot rest.

17. A collapsible folding chair comprising:

a chair seat extending between two side braces;

a chair back extending between two back braces;

two front leg supports, wherein the two front leg supports together comprise an X-shaped scissor leg structure;

two back leg supports, wherein the two back leg supports together comprise an X-shaped scissor leg structure, each of the front and back X-shaped scissor leg structures comprising two leg supports each having an upper support and a lower support;

a double-socketed joint corresponding to each front leg support, each double-socketed joint being slidingly engaged with an upper end of a corresponding upper support and engaged with a front end of a side brace;

a triple-socketed joint corresponding to each back leg support, each triple-socketed joint being slidingly engaged with an upper end of a corresponding upper support, slidingly engaged with a lower end of a back brace, and engaged with a back end of a side brace;

an elastic cord connected between each triple-socketed joint and the corresponding back brace and having a length selected to be in a state of tension when the corresponding back brace is engaged with the corresponding triple-socketed joint, as well as to enable the corresponding back brace to be disengaged from the corresponding triple-socketed joint and pivoted about the triple-socketed joint to an upper side of the chair seat while the cord remains connected;

an elastic cord connected between each double-socketed joint and a corresponding front upper support and having a length selected to be in a state of tension when the corresponding front upper support is engaged with the corresponding double-socketed joint, as well as to enable the corresponding front upper support to be disengaged from the corresponding double-socketed joint and pivoted about the double-socketed joint to an underside of the chair seat while the cord remains connected;

an elastic cord connected between each triple-socketed joint and the corresponding back upper support and having a length selected to be in a state of tension when the corresponding back upper support is engaged with the corresponding triple-socketed joint, as well as to enable the corresponding back upper support to be disengaged from the corresponding triple-socketed joint and pivoted about the triple-socketed joint to an underside of the chair seat while the cord remains connected; and two pivotal joints, each pivotal joint engaged with a lower end of a corresponding upper support and slidingly engaged with an upper end of a corresponding lower support, a separate lower elastic cord connected between each lower support and a corresponding pivotal joint and having a length selected to be in a state of tension when the corresponding lower support is engaged with the corresponding pivotal joint, as well as to enable a corresponding lower support to be disengaged from a corresponding pivotal joint and pivoted about the pivotal joint to a corresponding upper support while the lower cord remains connected.

18. The collapsible folding chair of claim 17 wherein each upper support comprises an upper support tube and each lower support comprises a lower support tube, and further comprising a separate support tube end cap engaged at a lower end of each lower support tube, wherein each lower elastic cord is threaded through a corresponding lower support tube and connected to an eyelet in a corresponding support tube end cap.

19. The collapsible folding chair of claim 18 wherein the upper and lower leg support tubes each comprise a carbon fiber tube.

20. The collapsible folding chair of claim 17 wherein the chair seat is at least about one foot off the ground.

21. The collapsible folding chair of claim 17 wherein the chair seat and chair back are a single piece of flexible material.

22. The collapsible folding chair of claim 21 wherein the triple-socketed joints comprise cast spherical joints.

23. The collapsible folding chair of claim 17 wherein the double-socketed joints and the triple-socketed joints each comprise injection molded plastic joints.

24. The collapsible folding chair of claim 17 wherein the chair back makes an angle greater than about ninety degrees with the chair seat.

25. The collapsible folding chair of claim 17 wherein the two back leg supports each makes an angle greater than about ninety degrees with the chair seat.

26. A collapsible support structure comprising:

a support surface extending between at least two side braces;

four leg supports configured as two X-shaped scissor leg structures each of two leg supports, each of the two leg supports having an upper support and a lower support;

a separate support disk engaged in a lower end of each lower leg support for distributing weight around a corresponding support when that tube is supporting weight;

a separate socket joint corresponding to each leg support, each socket joint being slidingly engaged with an upper end of a corresponding upper support and engaged with an end of a side brace;

a separate elastic cord corresponding to each leg support, each elastic cord being connected between a corresponding socket joint and an upper support, and having a length selected to be in a state of tension when the corresponding upper support is engaged with the corresponding socket joint, as well as to enable the corresponding upper support to be disengaged from the corresponding socket joint and pivoted about the socket joint to the support surface while the cord remains connected; and two pivotal joints, each pivotal joint engaged with a lower end of a corresponding upper support and slidingly engaged with an upper end of a corresponding lower support, a separate lower elastic cord connected between each lower support and a corresponding pivotal joint and having a length selected to be in a state of tension when the corresponding lower support is engaged with the corresponding pivotal joint, as well as enable a corresponding lower support to be disengaged from a corresponding pivotal joint and pivoted about the pivotal joint to a corresponding upper support while the lower cord remains connected.

* * * * *